US011165188B2

(12) United States Patent
Carle

(10) Patent No.: US 11,165,188 B2
(45) Date of Patent: Nov. 2, 2021

(54) ELECTRIC CONNECTOR PANEL TO BE MOUNTED IN A DEVICE HOUSING

(71) Applicant: Amphenol-Tuchel Electronics GmbH, Heilbronn (DE)

(72) Inventor: Michael Carle, Heilbronn (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 25 days.

(21) Appl. No.: 16/462,295

(22) PCT Filed: Nov. 15, 2017

(86) PCT No.: PCT/EP2017/079271

§ 371 (c)(1),
(2) Date: May 20, 2019

(87) PCT Pub. No.: WO2018/091500

PCT Pub. Date: May 24, 2018

(65) Prior Publication Data

US 2019/0319397 A1 Oct. 17, 2019

(30) Foreign Application Priority Data

Nov. 21, 2016 (DE) ..... 10 2016 122 397.2

(51) Int. Cl.

| | |
|---|---|
| ***H01R 13/73*** | (2006.01) |
| ***H01R 13/52*** | (2006.01) |
| ***H01R 13/518*** | (2006.01) |
| ***H01R 13/622*** | (2006.01) |
| ***H01R 13/74*** | (2006.01) |

(52) U.S. Cl.
CPC ..... *H01R 13/5202* (2013.01); *H01R 13/518* (2013.01); *H01R 13/622* (2013.01); *H01R 13/743* (2013.01)

(58) Field of Classification Search
CPC . H01R 13/5202; H01R 13/518; H01R 13/622
USPC ..... 439/559, 556, 542.1
See application file for complete search history.

(56) References Cited

U.S. PATENT DOCUMENTS 3,581,268 A * 5/1971 Akst ..... H01R 31/02 439/507
3,611,256 A * 10/1971 Abair ..... H01R 13/5025 439/559
3,803,531 A * 4/1974 Sorensen ..... G21C 17/116 439/190

(Continued)

FOREIGN PATENT DOCUMENTS

CN 204088721 U 1/2015
DE 197 49 852 A1 6/1999

(Continued)

*Primary Examiner* — Neil Abrams
(74) *Attorney, Agent, or Firm* — Blank Rome LLP

(57) ABSTRACT

An electronic connector panel that mounts on a wall of a device housing. The electronic connector panel has at least two integrated electric connectors, the housings of which are interconnected by a common mounting plate. There is at least one contact member for each electric connector as well as at least one contact element per contact member. A flat sealing member with openings for both connectors may be used between the connector panel and the wall of the device.

6 Claims, 3 Drawing Sheets

(56) References Cited

U.S. PATENT DOCUMENTS 3,987,928 A * 10/1976 Mori ..... H02G 3/14 220/241
4,163,137 A * 7/1979 Close, Jr. ..... H02G 3/123 174/66
4,249,788 A * 2/1981 McNeel ..... H01R 13/5219 439/272
4,293,173 A * 10/1981 Tricca ..... H01R 13/443 174/67
4,343,411 A * 8/1982 Chesnut ..... H02G 3/14 174/67
4,836,802 A * 6/1989 Phillips ..... H01H 85/2035 337/187
5,277,610 A * 1/1994 Krehbiel ..... H01R 13/74 439/271
5,501,609 A * 3/1996 Watanabe ..... H01R 13/5202 439/277
5,562,292 A * 10/1996 Roy ..... B60R 16/0222 277/634
5,775,944 A * 7/1998 Flask ..... H01R 13/743 439/556
5,947,766 A * 9/1999 Tsuji ..... H01R 13/748 439/559
6,089,910 A * 7/2000 Suzuki ..... H01R 13/5202 439/281
6,254,428 B1 * 7/2001 Murakami ..... H01R 13/5202 439/556
6,422,899 B1 * 7/2002 Miyazaki ..... H01R 13/5202 439/271
6,669,506 B2 * 12/2003 Newton ..... B60T 13/665 439/559
6,848,938 B2 * 2/2005 Miyamoto ..... H01R 13/743 439/556
7,160,147 B1 * 1/2007 Stephan ..... H01R 9/24 174/60
7,329,145 B2 * 2/2008 Yagome ..... H01R 13/506 439/271
7,341,484 B2 * 3/2008 Yamamoto ..... H01R 13/5202 439/271
7,396,254 B2 * 7/2008 Harmelink ..... H01R 13/518 439/540.1
8,113,800 B2 * 2/2012 Koitabashi ..... H02K 5/225 417/410.5
8,167,634 B2 * 5/2012 Fujiwara ..... H01R 13/748 439/271
8,175,583 B2 * 5/2012 Klassen ..... G06F 16/958 455/414.1
8,979,580 B2 * 3/2015 Bitzer ..... H02K 5/10 439/560
9,059,534 B2 * 6/2015 Endo ..... H01R 13/5205
9,601,864 B2 * 3/2017 Schmidt ..... H01R 13/5202
10,224,666 B2 * 3/2019 Aoshima ..... H01R 13/6585
10,516,232 B2 * 12/2019 Westerfield ..... H01R 13/42
10,630,021 B2 * 4/2020 Shiraishi ..... H01R 12/716
10,879,645 B2 * 12/2020 Zhang ..... H01R 13/746
11,018,462 B2 * 5/2021 Akagi ..... H01R 13/506
2009/0163043 A1 6/2009 Demers et al.
2016/0164220 A1 * 6/2016 Kataoka ..... H01R 13/5202 439/559

FOREIGN PATENT DOCUMENTS

DE 10 2008 005 494 7/2008
JP 2011-238507 A 11/2011

* cited by examiner

ELECTRIC CONNECTOR PANEL TO BE MOUNTED IN A DEVICE HOUSING

RELATED APPLICATIONS

This application is a national stage application of International Application No. PCT/2017/079271, filed Nov. 15, 2017, which is related to and claims priority to German Patent Application No. 102016 122 397.2, filed Nov. 21, 2016, the entire disclosures of which are hereby incorporated by reference.

The invention relates to a connector panel for installation in a device housing.

A wide variety of embodiments of connectors is already known from the prior art. However, if the intention is for a plurality of connectors to be installed with a precisely defined spacing or position with respect to one another, in many available solutions a complex measurement and alignment process needs to take place during mounting. In addition, separate grounding usually needs to be produced between the connectors and, if desired, the contacts of the connectors usually need to be connected to one another.

The invention is therefore based on the object of overcoming the abovementioned disadvantages and providing a simple and inexpensive solution which makes mounting quicker and easier in comparison with conventional solutions.

This object is achieved by the combination of features as claimed in patent claim 1.

In accordance with the invention, therefore, a connector panel is proposed for mounting on a device housing wall of a device housing having an interior, wherein the connector panel has at least two integrated connectors, the respective housings of said connectors being connected to one another via a common mounting plate, and each connector has in each case one contact body and at least one contact element per contact body.

An advantageous embodiment is present in this case if an apparatus for premounting the connector panel in the device housing is formed on the mounting plate, preferably in the form of latching elements on the mounting plate which latch into corresponding latch-in elements of the device housing. In this case, the premounting forms the first part of the entire mounting process, in which first the panel is inserted into the housing. The apparatus for premounting in this case fixes the panel in all directions if a corresponding mating piece is formed on the housing. In this case, however, as yet the device housing is not completely sealed off from the ingress of dust, dirt or fluids as a result of the premounting. Complete sealing is only realized by the final mounting.

It has proven to be advantageous if a mounting point, suitable for the connection of a PE conductor, is provided on the mounting plate. In this case, the mounting point is designed in such a way that the PE conductor can be released again without any destruction.

It is furthermore advantageous if the mounting plate is formed cohesively with the respective housing of the connectors. As a result, the number of required component parts is reduced and increased stability and dimensional stability of the thus integrally formed components is achieved.

In this case, it is of particular advantage if the mounting plate, the respective housings of the connectors, the mounting point and the apparatus for premounting are configured integrally as a cast metal part. By virtue of this embodiment, which represents a cohesive connection of all components involved, a high degree of stability and dimensional stability and a reduction in the component parts are achieved. In addition, all of the metallic housing components of the connector panel can thus be grounded jointly via the mounting point and are thus also brought to a common potential.

A preferred embodiment is present if a sealing surface plane of a first connector which is used for sealing off the device housing from the ingress of foreign matter through the aperture created for the connector is in the same plane as a sealing surface plane of a second connector and therefore forms a common sealing surface plane.

In this case, it is particularly advantageous if a sealing element for the at least two connectors is arranged on the common sealing surface plane thereof. As a result, both a reduction in the components and simplified mounting are achieved. By virtue of the thus enlarged sealing surface, improved sealing with respect to the ingress of dust, dirt and/or fluids into the device housing after the final mounting is also ensured. In this case, the final mounting of the connector panel corresponds to the application of a permanent force on the connector panel, wherein the force pushes or pulls the mounting plate against the sealing element and the sealing element against the device housing wall, with the result that the sealing element seals off the apertures in the device housing which are necessary for passing through the connectors of the connector panel.

It is advantageous in this case if the surface of the sealing element, in the mounted state, rests flat against the device housing wall, wherein the surface runs parallel to the common sealing surface plane, and the sealing element furthermore has a uniform thickness.

A likewise advantageous embodiment provides that a surface of the sealing element rests, in the mounted state, against the device housing wall, wherein the surface does not run parallel to the common sealing surface plane, and the sealing element therefore has different thicknesses.

It is advantageous for sealing purposes in this case if the sealing element is closed circumferentially around the connector contours, at least where the sealing element rests against the housings of the connectors, and forms a spectacle frame-like shape.

An advantageous implementation in this case envisages that the sealing element is positioned between the common mounting plate and the device housing wall in the interior of the device housing.

It is advantageous for mounting in this case if the at least two connectors form an external thread on the outer circumference of part of their respective housing which, in the mounted state, is not positioned in the interior. After the premounting, in each case one screw nut can then be applied to these external threads and the final mounting can be implemented by virtue of these screw nuts being tightened. This also realizes complete sealing-off of the housing at the apertures or openings introduced for mounting purposes.

A preferred embodiment is likewise present if an electrically conductive connection is formed between a contact element of one contact body and a contact element of a further contact body. This is particularly advantageous if the terminals of a connector of the connector panel are intended to be looped through onto another connector of the connector panel. For this purpose, all of the contact elements of a contact body then need to be electrically conductively connected to the corresponding contact elements of another contact body. This also facilitates the connection of a connector panel provided for this purpose since this can take place as early as during the production process or at least prior to installation.

A further preferred embodiment in this case envisages an adapter connector, which, in the mounted state, is positioned in the interior of the device housing, and one contact element of which is connected to the contact element of at least one connector via a second electrically conductive connection. As a result, the connection of the contact elements in the interior of the housing can be performed particularly easily since complex wiring of the individual contact elements of the contact bodies can be performed as early as prior to mounting and an electrical connection between other components in the interior of the device housing can be realized very easily later via the adapter plug.

Other advantageous developments of the invention are characterized in the dependent claims and will be illustrated in more detail below together with the description of the preferred embodiment of the invention with reference to the figures, in which:

The figures are schematic by way of example. Identical reference symbols in the figures indicate identical functional and/or structural features.

Figure 1:
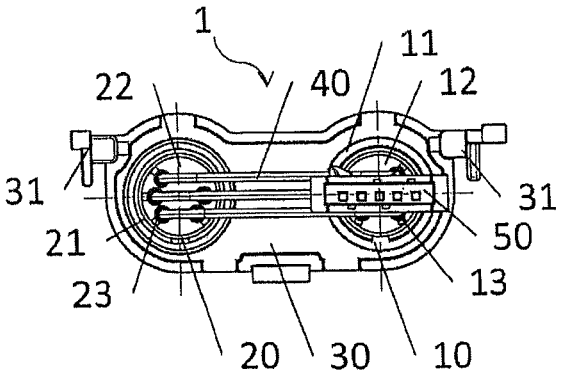
FIG. 1 shows a rear view of a connector panel.

FIG. 1 shows a connector panel 1 in a rear view. In this case, in addition to the housings 11 and 21 of two connectors 10 and 20, their respective contact bodies 12 and 22 as well as the mounting plate 30 can be seen. A plurality of contact elements 13 and 23 are visible within the contact bodies 12 and 22, wherein, by way of example, in each case only one has been identified.

The electrically conductive connection 40 which produces a contact between in each case one contact element of a connector and another contact element of another connector, as well as the adapter connector 50 and the apparatus 31 for premounting can likewise clearly be seen in the rear view. The premounting forms the first part of the entire mounting process, in which first the panel 1 is inserted into the housing.

Figure 2:
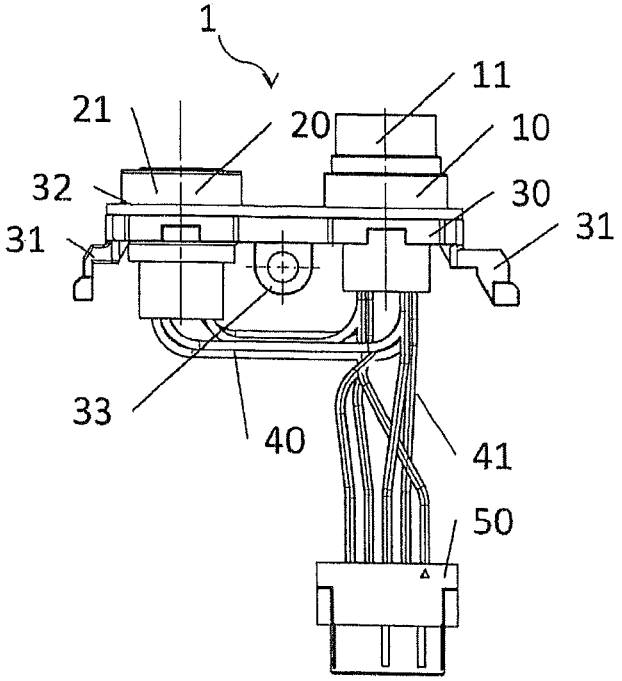
FIG. 2 shows a plan view of a connector panel.

FIG. 2 shows a connector panel 1 in a plan view. In this case, as well as the housings 11 and 21 of two connectors 10 and 20, the mounting plate 30, the sealing element 32 and the mounting point 33 can be seen. The mounting point, suitable for the connection of a PE conductor, is provided on the mounting plate. In this case, the mounting point is designed in such a way that the PE conductor can be released again without any destruction. The electrically conductive connection 40 which produces a contact between in each case one contact element of the connector 10 and another contact element of the other connector 20, the electrically conductive connection 41 which produces a contact between at least one contact element of the connector 20 and the contact element of the adapter connector 50, and the apparatus 31 for premounting can likewise also clearly be seen in the plan view.

Figure 3:
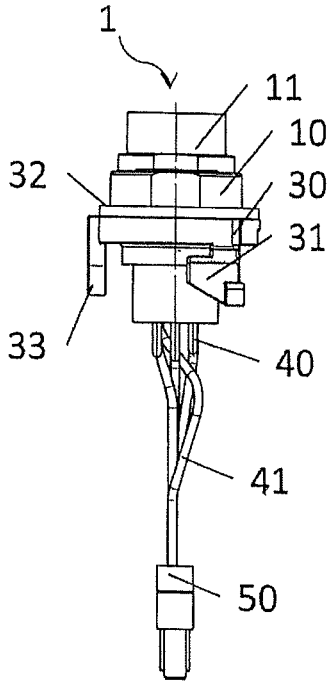
FIG. 3 shows a side view of a connector panel.

FIG. 3 shows the side view of a connector panel 1, wherein, in addition to the connector 10, the housing 11 of said connector is shown. Also visible are the sealing element 32, the mounting plate 30, the mounting point 33, the apparatus for premounting 31 and the electrically conductive connection 40 and the electrically conductive connection 41, which produces a contact between at least one contact element of the connector 20 and the contact element of the adapter connector 50.

Figure 4:
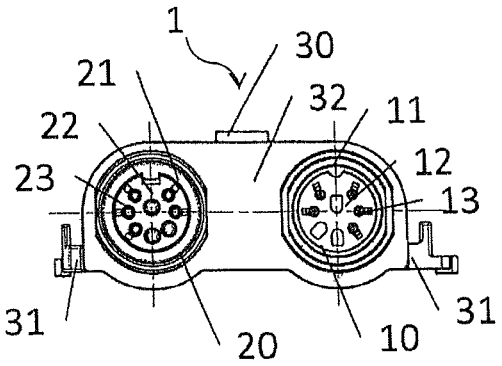
FIG. 4 shows a front view of a connector panel.

FIG. 4 shows the front view of the connector panel 1 in accordance with the first exemplary embodiment, showing the connectors 10 and 20 and the housings 11 and 21 thereof, contact bodies 12 and 22 and a plurality of contact elements 13, 23, of which in each case one contact element has been identified by way of example. Also visible is the sealing element 32, which is flat and runs in the form of spectacles around the housings 11 and 21, and a section of the mounting plate 30 behind this and the apparatus 31 for premounting. The premounting apparatus 31 can be in the form of arms which are bent back and protrude laterally away from the mounting plate 30 and is arranged on the mounting plate 30 in each case in a region beneath a central line M, passing through the two connectors 10, 20. The arms may consist of arm sections extending parallel to the sealing plane and of the arm sections running transversely thereto, as best seen in FIGS. 2 and 4.

The arm sections can form, in the direction of the side facing the interface side of the connector panel 1, in each case one stop surface which is aligned with the rear side of the mounting plate 30.

At the ends, blocks are formed on the transversely running arm sections, wherein webs of the arm sections can extend in the direction of the central line.

The mounting plate 30 has an upper edge running in a straight line and a lower edge which runs diametrically opposite the central line and can form two arcuate edge sections, which each can be formed directly adjacent to the position of the connectors 10, 20. The lower edge of the mounting plate 30 can run parallel to its upper edge between the two arcuate edge sections.

Figure 5:
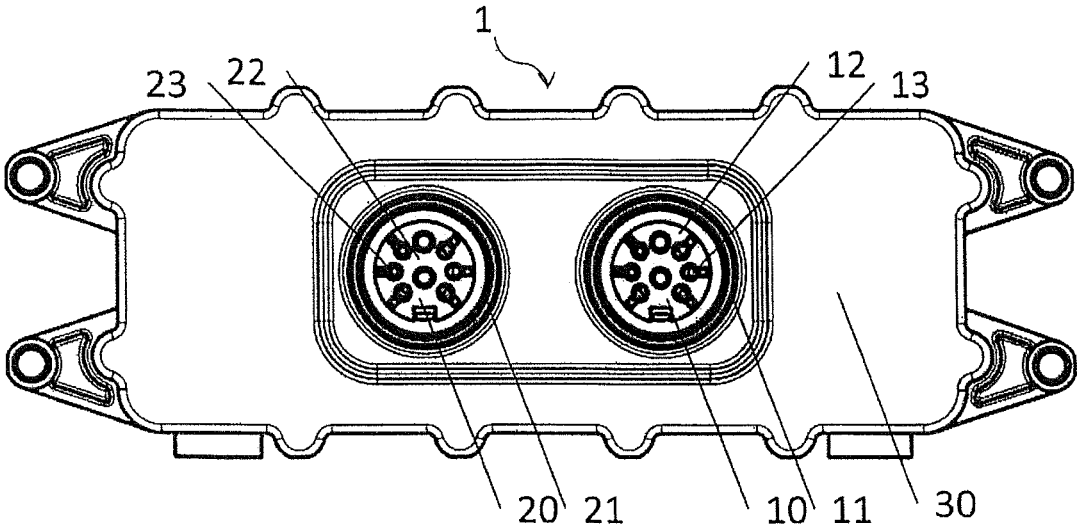
FIG. 5 shows a plan view of an alternative embodiment of a connector panel.

FIG. 5 shows an alternative embodiment in a plan view, showing a mounting plate 30 and the connectors 10 and 20 and the associated housings 11 and 21, contact bodies 12 and 22 and the contact elements 13 and 23, of which in each case one has been identified by way of example.

Figure 6:
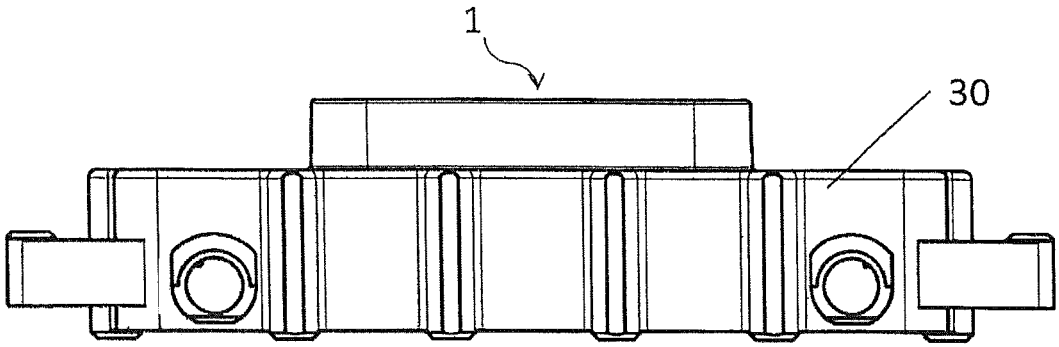
FIG. 6 shows a side view of an alternative embodiment of a connector panel.

FIG. 6 shows an alternative embodiment in a side view showing only the mounting plate 30.

The invention is not restricted in terms of its embodiment to the preferred exemplary embodiments specified above. Instead, a number of variants are conceivable which make use of the illustrated solution even in the case of embodiments which are in principle different.

LIST OF REFERENCE SYMBOLS

1 connector panel
10 connector
11 housing
12 contact body
13 contact element
20 connector
21 housing
22 contact body
23 contact element
30 mounting plate
31 premounting
32 sealing element
33 mounting point
40 connection
41 connection
50 adapter connector

The invention claimed is:

1. A connector panel for mounting on a device housing wall of a device housing having an interior, wherein the connector panel comprises at least two integrated connectors, respective housings of said connectors being connected to one another via a common mounting plate, in each case one contact body for each connector, and at least one contact element per contact body, wherein a sealing surface plane of the first connector, which is used for sealing off the device housing from the ingress of foreign matter through an aperture in the device housing wall created for the connector, is in the same plane as a sealing surface plane of the second or further connector to form a common sealing surface plane on the mounting plate, wherein a sealing element for the at least two connectors is arranged on the common sealing surface plane thereof, and the sealing element is closed circumferentially around the connector contours and forms a spectacle frame-like shape, and wherein the respective housings of said connectors and the common mounting plate are conductive and configured integrally to form a common ground potential.

2. The connector panel as claimed in claim 1, wherein a mounting point for a PE conductor is formed on the mounting plate.

3. The connector panel as claimed in claim 1, wherein a surface of the sealing element which is provided for sealing purposes rests, in the state in which the connector panel is mounted on a housing, against the device housing wall thereof, wherein the surface of the device housing wall runs parallel to the common sealing surface plane, and the sealing element has a uniform thickness.

4. The connector panel as claimed in claim 3, wherein the sealing element is positioned between the common mounting plate and the device housing wall in the interior of the device housing.

5. The connector panel as claimed in claim 1, wherein an electrically conductive connection is formed between a contact element of one contact body and a contact element of a further contact body.

6. The connector panel as claimed in claim 1, wherein an adapter connector, which, in the mounted state, is positioned in the interior of the device housing, and at least one contact element of which is connected to the contact element of at least one of the two connectors via a second electrically conductive connection.

* * * * *